US007443937B2

(12) United States Patent
Sarda

(10) Patent No.: US 7,443,937 B2
(45) Date of Patent: Oct. 28, 2008

(54) HIGH RESOLUTION DIGITAL CLOCK MULTIPLIER

(75) Inventor: Vivek Sarda, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 554 days.

(21) Appl. No.: 10/919,104

(22) Filed: Aug. 16, 2004

(65) Prior Publication Data

US 2006/0034404 A1 Feb. 16, 2006

(51) Int. Cl.
*H04L 7/00* (2006.01)

(52) U.S. Cl. ..... 375/354

(58) Field of Classification Search ..... 375/354, 375/357, 369, 372, 373, 374; 370/395.62, 370/507, 345.62; 455/265; 702/89; 713/375, 713/400; 327/161, 163, 105, 291, 294, 250
See application file for complete search history.

(56) References Cited

U.S. PATENT DOCUMENTS 5,552,726 A * 9/1996 Wichman et al. ..... 327/149
6,441,662 B2 * 8/2002 Ikeda ..... 327/160
6,677,794 B2 * 1/2004 Kim ..... 327/161
7,057,418 B1 * 6/2006 Fu et al. ..... 327/3
2003/0235260 A1 * 12/2003 Nakamura et al. ..... 375/374

* cited by examiner

*Primary Examiner*—Sam K Ahn
(74) *Attorney, Agent, or Firm*—Ronald O. Neerings; Wade James Brady, III; Frederick J. Telecky, Jr.

(57) ABSTRACT

A high resolution programmable clock synthesizer that is portable across processes and, thus, process independent is disclosed herein. The clock synthesizer provides a dynamic solution, in that the frequency of the desired clock signal is programmable. Initially, a control unit monitors the input clock signal and the output clock signal to provide the appropriate control signals to a delay string buffer and a fine tuning unit based upon the desired frequency of the output clock signal. While the delay string buffer provides a coarse adjustment to the input clock signal, fine control is provided through the use of the fine tuning unit which further adjustments to the input clock signal. This clock synthesizer exceeds the accuracy of known delay line oscillators by using drive strengths of the in-loop elements to provide a better granularity for the clock synthesizer. Thereby, high resolution is achieved through the use of coarse adjustment and fine adjustment.

13 Claims, 3 Drawing Sheets

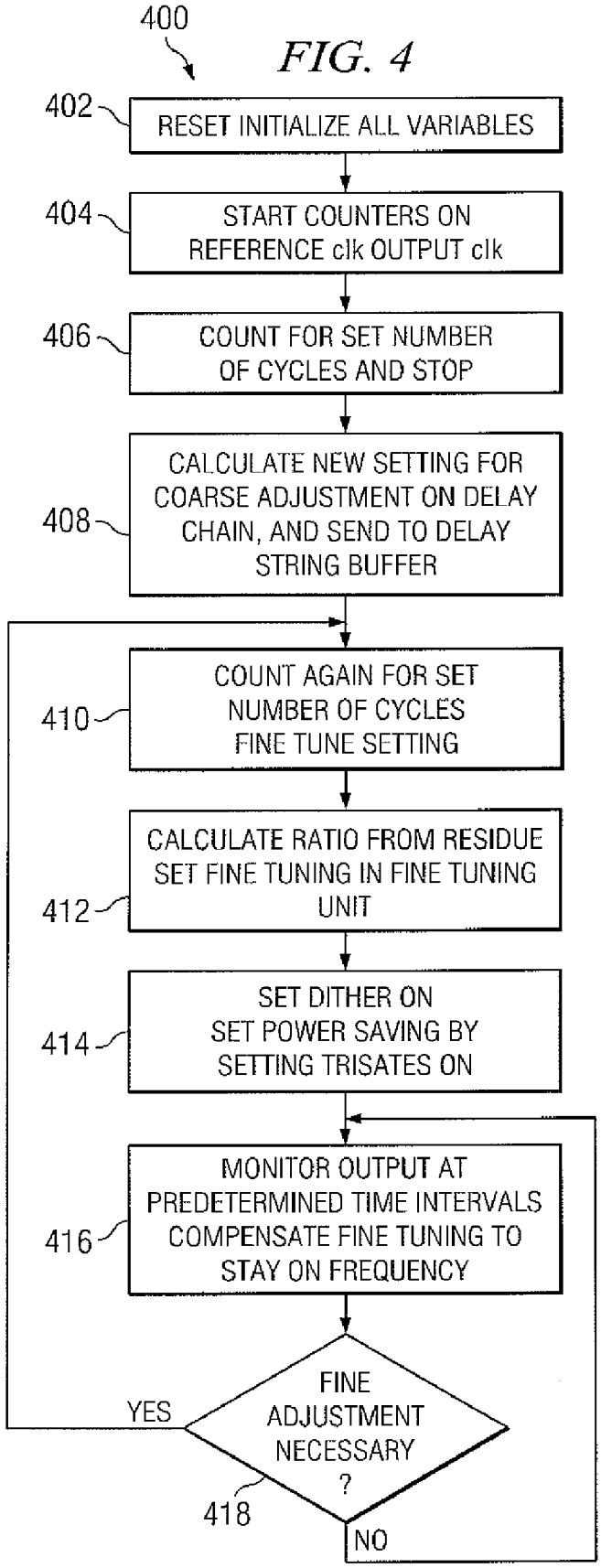
400
FIG. 4
402
RESET INITIALIZE ALL VARIABLES
404
START COUNTERS ON REFERENCE clk OUTPUT clk
406
COUNT FOR SET NUMBER OF CYCLES AND STOP
408
CALCULATE NEW SETTING FOR COARSE ADJUSTMENT ON DELAY CHAIN, AND SEND TO DELAY STRING BUFFER
410
COUNT AGAIN FOR SET NUMBER OF CYCLES FINE TUNE SETTING
412
CALCULATE RATIO FROM RESIDUE SET FINE TUNING IN FINE TUNING UNIT
414
SET DITHER ON SET POWER SAVING BY SETTING TRISATES ON
416
MONITOR OUTPUT AT PREDETERMINED TIME INTERVALS COMPENSATE FINE TUNING TO STAY ON FREQUENCY
FINE ADJUSTMENT NECESSARY ?
YES
NO
418

HIGH RESOLUTION DIGITAL CLOCK MULTIPLIER

FIELD OF THE INVENTION

The present invention relates to clock multipliers, and, more particularly, to a high resolution fully digital clock synthesizer.

BACKGROUND OF THE INVENTION

Integrated circuits may include clock multiplier circuits. Generally, the clock multiplier circuit in an integrated circuit is used for multiplying the frequency of a clock input (or inputs) to the integrated circuit to generate one or more clocks for internal use within the integrated circuit. The clock multiplier may be used to allow lower frequency clocks to be supplied to the integrated circuit, while still allowing the higher frequency operation within the integrated circuit.

Clock multipliers are widely employed in modern semiconductor devices and are commonly implemented through the use of a phase lock loop (PLL) that includes analog circuits such as a phase/frequency detector and a charge pump to bias a voltage controlled oscillator (VCO) such that a divided version of the VCO matches a reference clock. Since PLLs require analog components, these multipliers cannot be built from a purely digital library that utilizes processing technology optimized for purely digital circuits. Furthermore, such multipliers have long acquisition times, usually on the order of hundreds to thousands of clock cycles. Moreover, PLLs use a large amount of area and power and require both design and verification resources.

A technique employed for digitally doubling a clock involves XORing a reference clock signal with the same signal delayed by 90 degrees (one quarter clock cycle) as is provided in "Fully Digital Clock Synthesizer", Anderson et al. (U.S. Pat. No. 5,920,211), which is incorporated by reference herein. The XORed output will have a frequency which is twice the frequency of the reference clock signal. Ordinary circuit delay elements, however, vary widely with changing operating parameters such as voltage, temperature, and variances in integrated circuit processing. Thereby, the clock duty cycle will vary widely for the doubled clock.

Furthermore, the XOR method of clock doubling is also limited to obtaining a frequency which is twice the reference clock frequency. Thus, even if a method of adding a precise amount of delay (90 degrees) between the XOR inputs were devised, the frequency range achievable would be limited. At best, the frequencies which could be obtained from such a mechanism would be some power of two times the reference clock frequency.

The fully digital clock synthesizer of Anderson et al. provides a clock multiplier which may be implemented with only digital components and fabricated using only digital processes. The clock multiplier is capable of producing a frequency which is any whole number or fractional multiple of the input or reference clock frequency and it can obtain a precise duty cycle in the output clock signal. The fully digital clock synthesizer of Anderson et al., however, is limited in resolution by the minimum delay element in the delay cell string.

Thus, there is a need therefore for providing a fully digital clock synthesizer that provides highly accurate clocks without the need for any analog components, wherein the clock synthesizer is implemented with only digital components and fabricated using only digital processes. In addition, there is a need for a high resolution fully digital clock synthesizer that is not limited in resolution by the minimum delay element. Furthermore, there is a need to provide a clock multiplier capable of producing a frequency which is any whole number or fractional multiple of the input or reference clock frequency. Moreover, it would also be advantageous to obtain a precise duty cycle in the output clock signal.

SUMMARY OF THE INVENTION

The following presents a simplified summary in order to provide a basic understanding of one or more aspects of the invention. This summary is not an extensive overview of the invention, and is neither intended to identify key or critical elements of the invention, nor to delineate the scope thereof. Rather, the primary purpose of the summary is to present some concepts of the invention in a simplified form as a prelude to the more detailed description that is presented later.

To address the above-discussed deficiencies of the digital clock synthesizers, the present invention teaches a fully digital clock synthesizer that provides highly accurate clocks without the need for any analog components, wherein the clock synthesizer is implemented with only digital components and fabricated using only digital processes. Furthermore, high resolution clock synthesizer is not limited in resolution by the minimum delay element. Specifically, the clock synthesizer includes an exclusive OR gate connected to receive a Reset signal. A delay string buffer and a fine tuning unit connect serially in a feedback loop attached to the input of the exclusive OR gate. A control unit couples to receive the system clock and the output of the exclusive OR gate to generate a control signal on a bus of bit width (N+M), wherein N bits correspond to the number of bits necessary to control the delay string buffer and M bits correspond to the number of bits necessary to control the fine tuning unit.

More particularly, the delay string buffer includes a multiplexer and tristated buffers. The buffers couple in series and are connected to the inputs of the multiplexer. The clock input signal received by the delay string buffer propagates through the tristated buffers of differing weights to produce a coarse adjustment in the input clock signal. The fine tuning unit, however, includes an input buffer, AND gates, intermediate buffers and an OR gate. The input buffer couples to receive a clock input signal to provide a signal for each AND gate. In addition, each AND gate couples to receive a control input from the control unit. A respective number of intermediate buffers connect to each respective one of the AND gates. The OR gate connects to each intermediate buffer.

In operation, the control unit having a counter will count the number of cycles required to provide the desired clock signal. The control unit will generate a coarse adjustment for the delay string buffer and a fine adjustment for the fine tuning unit. Furthermore, the control unit applies dither to the clock signal. It controls each tristated buffer in the clock synthesizer, switching each on and off, in an effort to save power. The control unit monitors the signal generated at predetermined time intervals and calculates fine adjustments to the signal as needed.

The advantages include but are not limited to a high resolution HDL programmable clock synthesizer that is portable across processes and, thus, process independent. Fine control using drive strength to achieve steps smaller than 2 picoseconds. The clock synthesizer in accordance with the present invention provides a dynamic solution, in that the frequency of the desired multiple clock can be changed and, thus, is not fixed. Autolayout of the clock synthesizer control unit is not limited as in past designs and, thereby, provides significant savings in design time. Power and area requirements are significantly lower than traditional clock synthesizers. Furthermore, this type of implementation is specially suited to low power applications that need a good duty cycle.

The following description and annexed drawings set forth in detail certain illustrative aspects and implementations of the invention. These are indicative of but a few of the various ways in which the principles of the invention may be employed.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 4 shows the state diagram for the control unit for the clock synthesizer in accordance with the present invention;

DETAILED DESCRIPTION OF PREFERRED EMBODIMENTS

Figure 1:
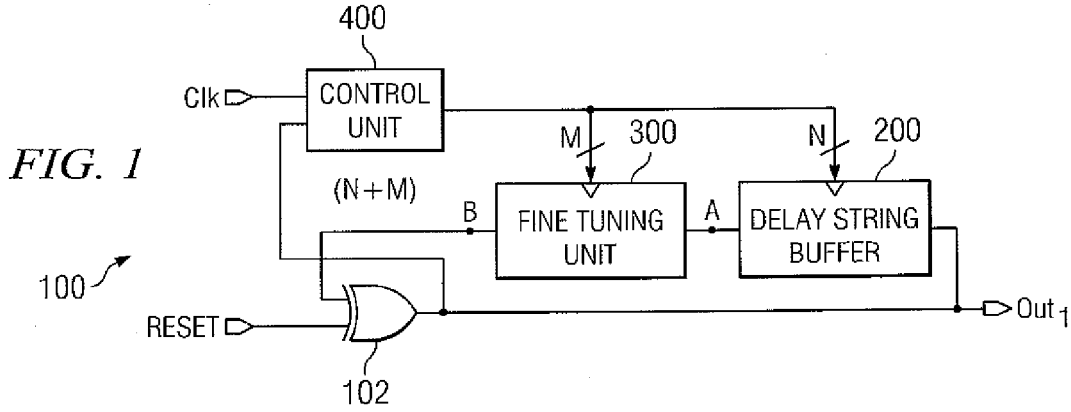
FIG. 1 illustrates a block diagram of a high resolution fully digital clock synthesizer in accordance with the present invention.

One or more exemplary implementations of the present invention will now be described with reference to the attached drawings, wherein like reference numerals are used to refer to like elements throughout. The various aspects of the invention are illustrated below in an exemplary clock synthesizer 100 employing a control unit 400, a delay string buffer 200 and a fine tuning unit 300, although the invention and the appended claims are not limited to the illustrated examples.

Referring to FIG. 1, an exemplary high resolution clock synthesizer 100 is illustrated, comprising a control unit 400, a delay string buffer 200, a fine tuning unit 300 and an exclusive OR gate 102. Similar to a delay line ring oscillator, clock synthesizer 100 includes delay string buffer 200, in addition to fine tuning unit 300, in an effort to provide a variable delay. A reset signal Reset provides input to the exclusive OR gate 102, having a feedback loop that couples to the second input of the exclusive OR gate 102. The feedback loop includes delay string buffer 200 connected in series with the fine tuning unit 300. The control unit 400 receives the system clock input signal Clk along with the output from exclusive OR gate 102 to provide a control signal across a bus having the width (N+M), wherein N is the number of bits necessary to control the delay string buffer 200 and M is the number of bits necessary to control the fine tuning unit 300.

Control unit 400 receives an integer multiplier input along with an input signal and monitors the clock cycles of internal clock signals generated after adjustments of delay string buffer 200 and fine tuning unit 300 have been made. As will be described in detail, control unit 400 calculates the coarse adjustment, the fine adjustment, and dither necessary to obtain a precise frequency match with the desired frequency output. Since control unit 400 continuously monitors and adjusts the clock input signal at predetermined intervals of time within every few clock cycles, the clock synthesizer in accordance with the present invention is relatively insensitive to delay changes due to process, voltage, and temperature (PVT) variations.

Figure 2:
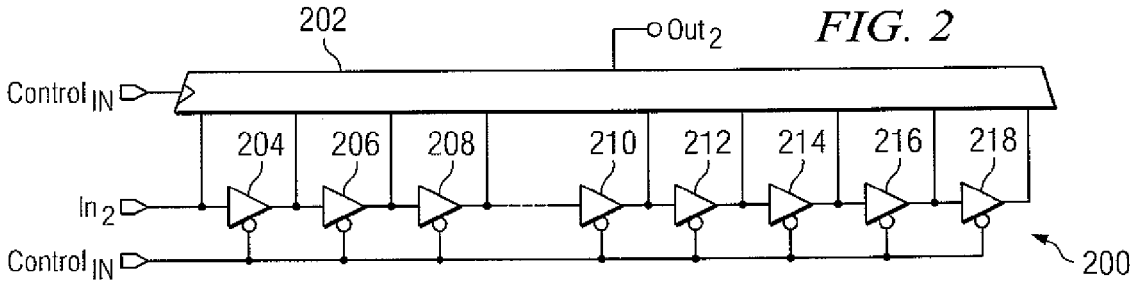
FIG. 2 displays a delay string buffer for implementation within the clock synthesizer of FIG. 1.

FIG. 2 illustrates an embodiment of a delay string buffer 200 that includes buffers 204-218 and a multiplexer 202. The signal from the exclusive OR output as shown in FIG. 1 is received by the delay string buffer 200 at input $IN_2$. The control signal provided by control unit 400 is received at the tristated buffers at input $Control_{IN}$. As shown, the tristated buffers 204-218 are connected in series. Each respective input and output of each tristated buffer connects to multiplexer 202 for the purpose of providing a clock signal that has been modified by the coarse adjustment supplied through the tristated buffers 204-218 and the multiplexer 202 at output $Out_2$. Further, in an effort to conserve power, control unit 400 provides control signals to specific ones of tristated buffers 204-218 to switch 'off' those that are not in use. Those skilled in the art would observe that delay string buffer 200 may include a variable number of tristated buffers depending upon the desired frequency range produced by clock synthesizer 100.

Figure 3:
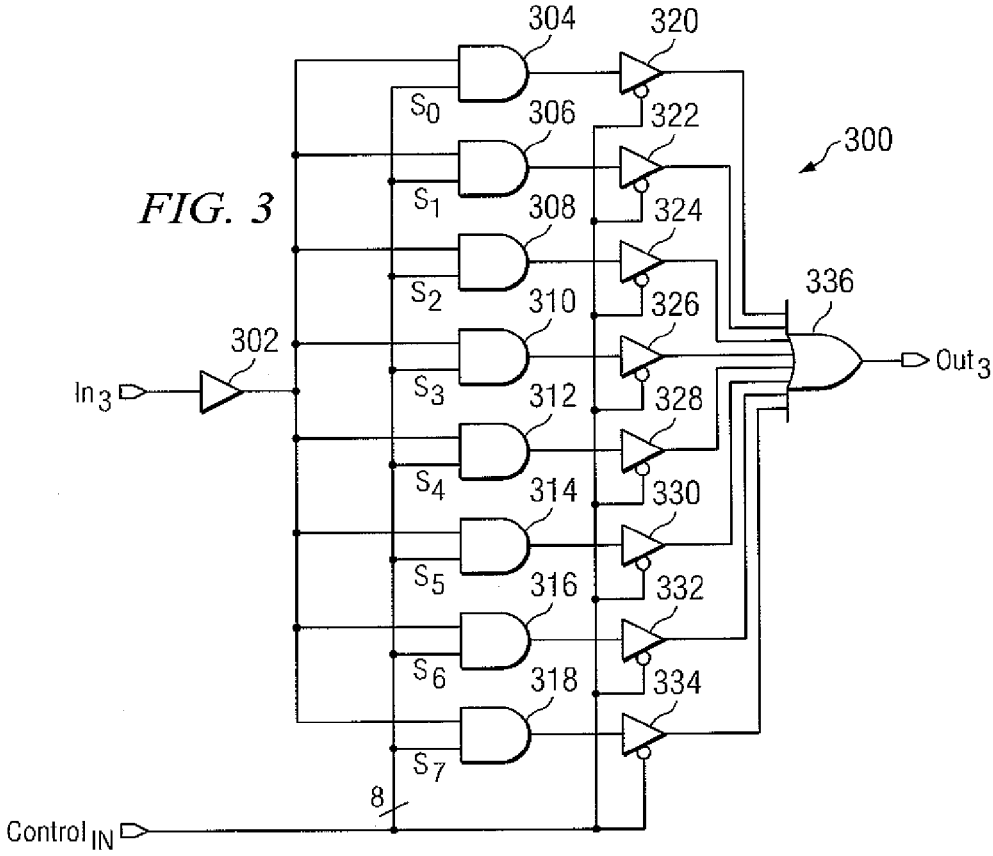
FIG. 3 is a logic circuit for the fine tuning unit in accordance with the present invention as implemented in the clock synthesizer of FIG. 1.

FIG. 3 displays the logic schematic for the fine tuning unit 300 that includes, an input buffer 302, AND gates 304-318, intermediate tristated buffers 320-334, OR gate 336. The signal from the output of delay string buffer 200 as shown in FIG. 1 is received by fine tuning unit 300 at input $IN_3$. The control signal received at $Control_{IN}$ determines the path of the signal feed into the input $IN_3$ through buffer 302 by providing a variable load to AND gates 304-318. Ultimately, a clock signal is generated at the output of OR gate 336 having the fine tuning adjustment supplied by the fine tuning unit 300. As with the delay string buffer 200, control unit 400 provides control signals to specific ones of intermediate tristated buffers 320-334 to switch 'off' the buffers 320-334 that are not in use to conserve power.

FIG. 4 illustrates the flow chart for the method of generating control for the clock synthesizer in accordance with the present invention. More particularly, FIG. 4 specifies the operation of control unit 400 as shown in FIG. 1. In a first step 402, the clock synthesizer 100 is reset and all variables within the control unit 400 are initialized. In step 404, a counter (not shown) within the control unit 400 is begun to count the cycles of the output clock. Accordingly, the control unit 400 calculates the ratio of the output clock to the input clock and compares it with the desired ratio corresponding to the desired clock frequency. In step 408, control unit 400 generates the coarse adjustment for the delay string buffer 200 and sends control signals to the delay string buffer 200 to set the coarse adjustment. Control unit 400 continues to count the cycles of the output clock and calculates the ratio of the output clock to the input clock and compares it with the desired ratio corresponding to the desired clock frequency in an effort to calculate a fine tuning adjustment for the fine tuning circuit 300 in step 410. A residue is calculated from the ratio and the fine tuning adjustment control signals are sent to the fine tuning unit 300 to set the fine adjustment in step 412. In an effort to obtain a more precise frequency, control unit 400 provides a signal for the addition of dither to the resultant clock signal in step 414. Dither is provided by pseudo-randomly shifting the resultant clock signal. In addition, in step 414, control unit 400 switches specific tristated buffers 'on' and 'off' within the fine tuning unit 300 and the delay string buffer 200 in an attempt to save power. The clock signal generated is monitored continuously at predetermined time intervals and a fine tuning adjustment is provided to the signal as needed, as is shown in step 416. If fine tuning adjustment is determined to be needed (YES at 418). the control unit returns to 410 to again calculate a fine tuning adjustment for the fine tuning circuit 300.

Figure 5:
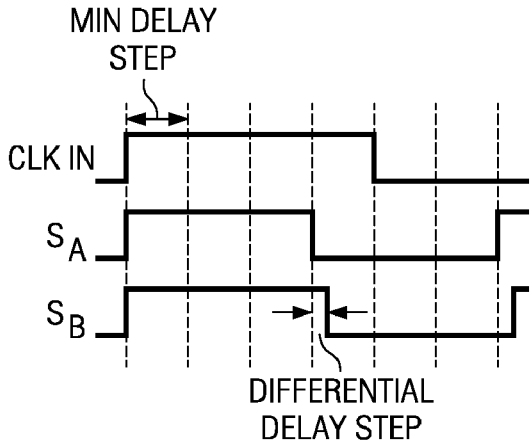
FIG. 5 is a timing diagram illustrating exemplary operation of the clock synthesizer shown in FIG. 1.

FIG. 5 provide the timing diagram for the exemplary clock synthesizer in accordance with the present invention. As shown the clock input signal has a cycle of 8 steps. The signal $S_A$ at point A as is illustrated in FIG. 1 is shown to have been derived from the delay string buffer 200 with the minimum delay steps that it can provide. Note that the clock signal can only be modified with respect to the minimum delay step of the delay string buffer 200. The signal $S_B$ at point B as is illustrated in FIG. 1 is shown, however, to provide a differential delay step to the resultant clock signal after the signal is fed through fine tuning unit 300. The differential delay step has been proven to have precision to less than 2 picoseconds.

Figure 6:
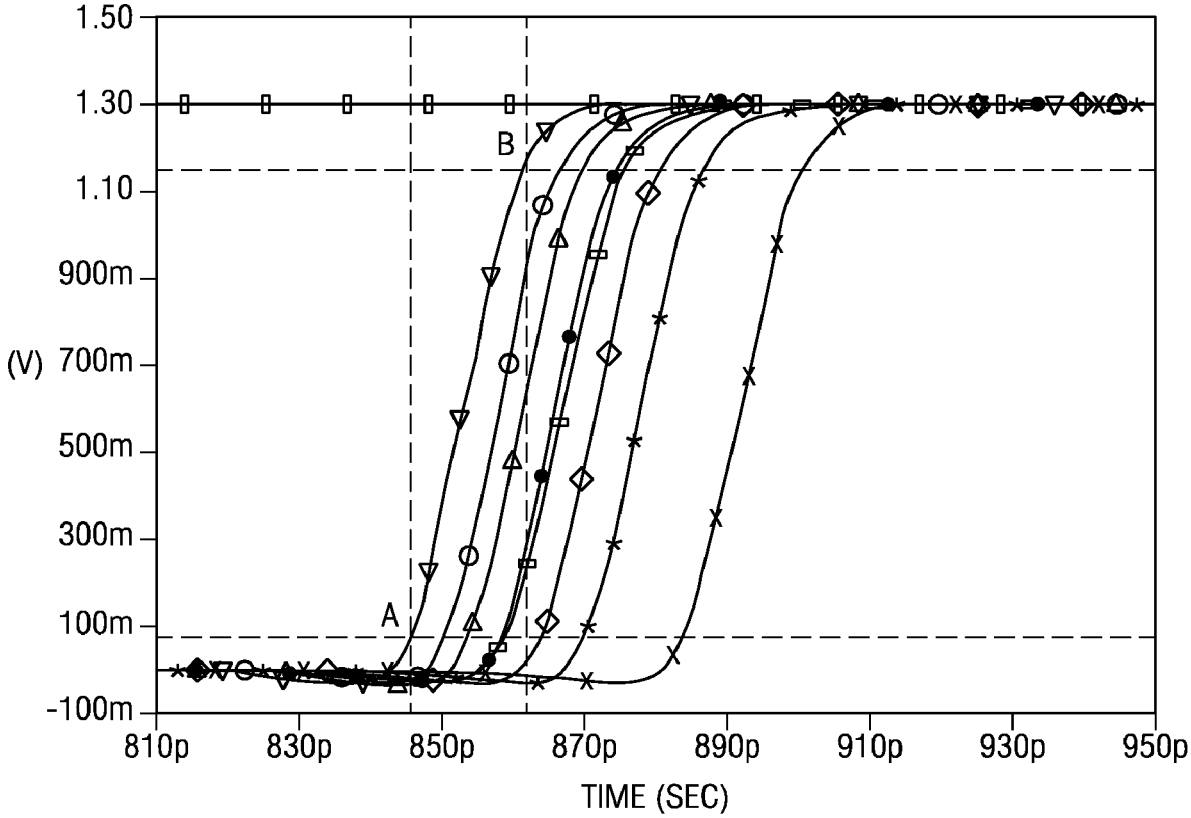
FIG. 6 is the transient response commensurate with the exemplary operation of the clock synthesizer shown in FIG. 1.

FIG. 6 provides the transient response for a signal corresponding to the use of AND gates 304-318. Since AND gates 304-318 have differing strengths, the slope occurs at different delayed times according to differing output frequencies. As shown, intermediate steps can be obtained for the resultant clock signal. Specifically, precision less than 2 picoseconds can be obtained. Thereby, the resolution is enhanced significantly. While a delay line oscillator is quite common in literature, this solution enhances the accuracy of the oscillator by using drive strengths of the in-loop elements to provide a better granularity for the clock synthesizer 100. The transient response serves as proof of high resolution of the clock synthesizer 100 in accordance with the present as compared to the known fixed step size of no greater than 45 picoseconds steps for known clock synthesizers.

The reader's attention is directed to all papers and documents which are filed concurrently with this specification and which are open to public inspection with this specification, and the contents of all such papers and documents are incorporated herein by reference.

All the features disclosed in this specification (including any accompany claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A clock synthesizer for generating a desired clock signal from an input clock signal, comprising:

an exclusive OR gate, having a first input, a second input and an output, the first input coupled to receive a reset signal;

a delay string buffer having an input, a control input and an output, the delay string buffer input coupled to the output of the exclusive OR gate, wherein;

a fine tuning unit, having an input, a control input and an output, the fine tuning unit input coupled to the output of the delay string buffer, the fine tuning unit output coupled to the second input of the exclusive OR gate; and a control unit, having a first input, a second input and an output, the first input of the control unit coupled to receive the input clock signal and the second input of the control unit coupled to the output of the exclusive OR gate to generate a control signal at the output;

wherein the control input of the delay string buffer is coupled to receive the control signal to provide a coarse adjustment of the input clock signal corresponding to the desired clock signal, and wherein the control input of the fine tuning unit is coupled to receive the control signal to provide a fine adjustment of the input clock signal corresponding to the desired clock signal.

2. The clock synthesizer of claim 1, wherein the delay string buffer comprises:

a multiplexer, having a plurality of inputs, a control input and an output, the multiplexer control input coupled to receive the control signal, wherein the output of the multiplexer provides the output of the delay string buffer; and a plurality of tristated buffers, each having an input, a tristate input, and output, each of the plurality of buffers coupled in series, the input of each of the plurality of buffers coupled to a respective input of the plurality of inputs of the multiplexer, the input of the least significant one of the plurality of tristated buffers coupled to receive the output of the exclusive OR gate through the input of the delay string buffer, each of the plurality of tristate inputs coupled to receive the control signal.

3. The clock synthesizer of claim 2, wherein the plurality of tristate inputs are coupled to receive the control signal to switch specific ones of the plurality of tristate inputs on and off to save power.

4. The clock synthesizer of claim 1, wherein the fine tuning unit comprises:

an input buffer coupled to the fine tuning unit input;

a plurality of AND gates, each having a first input, a second input and an output, each of the plurality of the first inputs of the AND gates coupled to the input buffer, each of the plurality of the second inputs of the AND gates coupled to receive a respective bit of the control signal;

a plurality of intermediate buffers coupled to a respective one of the plurality of outputs of the plurality of AND gates; and an OR gate, having an output and a plurality of inputs corresponding to the number of plurality of AND gates, wherein the plurality of inputs couple to each respective one of the plurality of intermediate buffers.

5. The clock synthesizer of claim 4, wherein the plurality of intermediate buffers are tristate buffers, having an input, a tristate input and an output, each one of the plurality of the tristate inputs coupled to receive the control signal to switch specific ones of the plurality of tristate inputs on and off to save power.

6. The clock synthesizer of claim 1, wherein a bus width of the output of the control unit is equal to the sum of the number (N) of bits necessary to control the fine tuning unit and the number (M) of bits necessary to control the delay string buffer.

7. A method of synthesizing a multiplied clock signal at a desired frequency, comprising:

a. receiving an input clock signal in a clock synthesizer;

b. resetting initialization variables for a control unit within the clock synthesizer;

c. generating a coarse adjustment for a delay buffer string within the clock synthesizer;

d. setting the coarse adjustment by sending control signals from the control unit to the delay buffer string;

e. generating a fine adjustment for a fine tuning unit within the clock synthesizer;

f. setting the fine adjustment by sending control signals from the control unit to the fine tuning unit;

g. providing dither to a generated clock signal by shifting the signal modified by the fine tuning unit:

h. monitoring the frequency of the generated clock signal at predetermined intervals (R) of time per second;

i. returning to step (e) when a fine adjustment of the generated clock signal is necessary; and j. returning to step (h) until the system that incorporates the clock synthesizer powers down.

8. The method of claim 7, wherein the method further comprises returning to step (c) when a coarse adjustment of the generated clock signal is necessary after the monitoring step (h).

9. The method of claim 7, wherein the step of generating a coarse adjustment, comprises:

a. counting the cycles of the output clock and the input clock;

b. calculating the ratio of output clock cycles to the number of input clock cycles;

c. comparing the ratio to a predetermined desired ratio corresponding to the desired frequency; and d. calculating coarse adjustment for a delay buffer string within the clock synthesizer corresponding to the desired frequency based upon the comparison of ratios.

10. The method of claim 7, wherein the step of generating a fine adjustment, comprises:

a. counting the cycles of the output clock and the input clock;

b. calculating the ratio of output clock cycles to the number of input clock cycles;

c. comparing the ratio to a predetermined desired ratio corresponding to the desired frequency;

d. calculating a residue from the comparison of ratios; and e. calculating fine adjustment for a fine tuning unit within the clock synthesizer corresponding to the desired frequency based upon the residue.

11. The method of claim 7, wherein predetermined number (R) is equal to 10.

12. The method of claim 7, wherein the method further comprises switching on and off a plurality of tristated buffers within the fine tuning unit to save power and generate a clock signal at the desired frequency.

13. The method of claim 7, wherein the method further comprises switching on and off a plurality of tristated buffers within the delay buffer string to save power and generate a clock signal at the desired frequency.

* * * * *